US011555602B1

(12) United States Patent
Xu

(10) Patent No.: US 11,555,602 B1
(45) Date of Patent: Jan. 17, 2023

(54) CEILING LAMP

(71) Applicant: Qingjun Xu, Dongguan (CN)

(72) Inventor: Qingjun Xu, Dongguan (CN)

( * ) Notice: Subject to any disclaimer, the term of this patent is extended or adjusted under 35 U.S.C. 154(b) by 0 days.

(21) Appl. No.: 17/738,336

(22) Filed: May 6, 2022

(30) Foreign Application Priority Data

Mar. 18, 2022 (CN) ..... 202220604647.5

(51) Int. Cl.

| | |
|---|---|
| ***F21V 21/30*** | (2006.01) |
| ***F21S 8/06*** | (2006.01) |
| ***F21V 23/04*** | (2006.01) |
| ***F21V 21/15*** | (2006.01) |
| ***F21Y 103/10*** | (2016.01) |
| ***F21Y 115/10*** | (2016.01) |

(52) U.S. Cl.
CPC ..... *F21V 21/30* (2013.01); *F21S 8/061* (2013.01); *F21V 21/15* (2013.01); *F21V 23/0442* (2013.01); *F21Y 2103/10* (2016.08); *F21Y 2115/10* (2016.08)

(58) Field of Classification Search
CPC ..... F21V 21/30; F21V 21/15; F21V 21/26; F21S 8/046; F21S 8/061
See application file for complete search history.

(56) References Cited

U.S. PATENT DOCUMENTS

| | | | | |
|---|---|---|---|---|
| 8,025,428 | B2 * | 9/2011 | Duguay | F21S 8/086 362/249.02 |
| 10,907,814 | B1 * | 2/2021 | Tang | F21S 8/061 |
| 11,112,101 | B1 * | 9/2021 | Jaslowski | F21V 21/30 |
| 2014/0049956 | A1 * | 2/2014 | Manahan | F21V 21/14 362/249.02 |
| 2020/0340633 | A1 * | 10/2020 | Chen | F21S 4/28 |
| 2022/0082218 | A1 * | 3/2022 | McDonald | G01J 1/0411 |

* cited by examiner

*Primary Examiner* — William N Harris

(74) *Attorney, Agent, or Firm* — Dicke, Billig & Czaja, PLLC

(57) ABSTRACT

A ceiling lamp is disclosed including a first lamp, a second lamp, and an angle adjusting and locking device. The first lamp and the second lamp are arranged at an interval, and the second lamp and the first lamp are rotatable with respect to each other. The angle adjusting and locking device is connected with the first lamp and the second lamp, and the angle adjusting and locking device is configured for locking the first lamp and the second lamp after they are rotated with respect to each other.

6 Claims, 4 Drawing Sheets

CEILING LAMP

CROSS-REFERENCE TO RELATED APPLICATIONS

This application is based on and claims the benefit of priority to Chinese Patent Application No. 2022206046475, filed on 18 Mar. 2022, the entire contents of which are incorporated by reference herein

TECHNICAL FIELD

The present disclosure relates to the technical field of illuminating lamp products, and more particularly, to a ceiling lamp.

BACKGROUND

A ceiling lamp is, for example, a ceiling mount lamp or a lamp suspended from a ceiling. Generally, due to a relatively fixed mounting position of the lamp, the lamp with relatively strong power is generally selected to meet a required luminosity. However, in practical application, there are different layouts of indoor appliances, for example, different products for sale have different requirements for the height and placement of shelves in shops. In this case, mounting an ordinary lamp may lead to strong luminosity in some areas and weak luminosity in some areas, so that the lamp has weak applicability, and cannot meet users' demand for indoor illumination.

SUMMARY

The disclosure aims to solve at least one of the technical problems in the existing technology. Therefore, a ceiling lamp is provided, which can improve applicability of a lamp.

A ceiling lamp according to an embodiment of the disclosure includes: a first lamp; a second lamp, wherein the first lamp and the second lamp are arranged at an interval; and the second lamp and the first lamp are rotatable with respect to each other; and an angle adjusting and locking device, wherein the angle adjusting and locking device is connected with the first lamp and the second lamp, and the angle adjusting and locking device is configured for locking the first lamp and the second lamp after the first lamp and the second lamp are rotated with respect to each other.

According to the above embodiment of the disclosure, the ceiling lamp at least has the following beneficial effects. An included angle between the first lamp and the second lamp can be adjusted according to an illuminating range, and when the included angle between the first lamp and the second lamp is determined, the first lamp and the second lamp are locked by the angle adjusting and locking device, so that the included angle between the first lamp and the second lamp is maintained. Then, the ceiling lamp with the fixed included angle is suspended from a ceiling, thus meeting illuminating requirements of different illuminating ranges. Therefore, the lamp according to the embodiment of the disclosure has stronger applicability.

According to some embodiments of the disclosure, both ends of the first lamp are provided with a first connecting plate inclined upwardly; both ends of the second lamp are provided with a second connecting plate inclined upwardly; and the first connecting plate is rotationally connected with and abutted against the second connecting plate located at the same end, and the angle adjusting and locking device is configured for locking the first connecting plate and the second connecting plate after the first connecting plate and the second connecting plate are rotated with respect to each other.

According to some embodiments of the disclosure, the angle adjusting and locking device is provided in two, the two angle adjusting and locking devices are located at opposite ends of the first lamp, one of the angle adjusting and locking devices is set as a bolt penetrating through the first connecting plate and the second connecting plate at a corresponding end, and the bolt is configured for locking the corresponding first connecting plate and second connecting plate.

According to some embodiments of the disclosure, the angle adjusting and locking device is provided in two, the two angle adjusting and locking devices are located at opposite ends of the first lamp, one of the angle adjusting and locking devices includes a first gear assembly, a second gear assembly, a spring and a pressing member, the first gear assembly is configured to penetrate through the first connecting plate at a corresponding end, and the second gear assembly is configured to penetrate through the second connecting plate at the corresponding end; one end of the first gear assembly is engaged with one end of the second gear assembly, and one end of the spring is abutted against one end of the second gear assembly; the other end of the spring is connected with the second connecting plate at the corresponding end; and the spring is configured for providing an elastic force for one end of the second gear assembly towards the first gear assembly, and one end of the pressing member is configured to penetrate through the first gear assembly to be abutted against one end of the second gear assembly, so that the spring is capable of being compressed when the pressing member is pressed, to separate the first gear assembly from the second gear assembly.

According to some embodiments of the disclosure, the angle adjusting and locking device is provided in two, the two angle adjusting and locking devices are located at opposite ends of the first lamp, one of the angle adjusting and locking devices includes a motor configured for adjusting an included angle between the first connecting plate and the second connecting plate.

According to some embodiments of the disclosure, the first lamp includes a first end shell and a first lamp body, the first end shell is detachably connected with the first lamp body, the second lamp includes a second end shell and a second lamp body, the second end shell is detachably connected with the second lamp body, and the angle adjusting and locking device is configured for locking the first end shell and the second end shell after the first end shell and the second end shell are rotated with respect to each other.

According to some embodiments of the disclosure, one end of the first lamp is provided with a jack, and an outer surface at one end of the first lamp and/or the second lamp far away from the jack is provided with a plug.

According to some embodiments of the disclosure, the first lamp or the second lamp is provided with a pull switch.

According to some embodiments of the disclosure, the ceiling lamp further includes: a connecting shaft, wherein the connecting shaft is arranged between the first lamp and the second lamp, and both ends of the connecting shaft are connected with the first lamp and the second lamp.

According to some embodiments of the disclosure, the ceiling lamp further includes at least one of: a sensing module and/or a voice control module.

The additional aspects and advantages of the disclosure will be given in part in the following description, and will become apparent in part from the following description, or will be learned through the practice of the disclosure.

BRIEF DESCRIPTION OF THE DRAWINGS

The above and/or additional aspects and advantages of the disclosure will become apparent and easy to understand from the descriptions of the embodiments with reference to the following drawings, wherein.

REFERENCE NUMERALS

Figure 1:
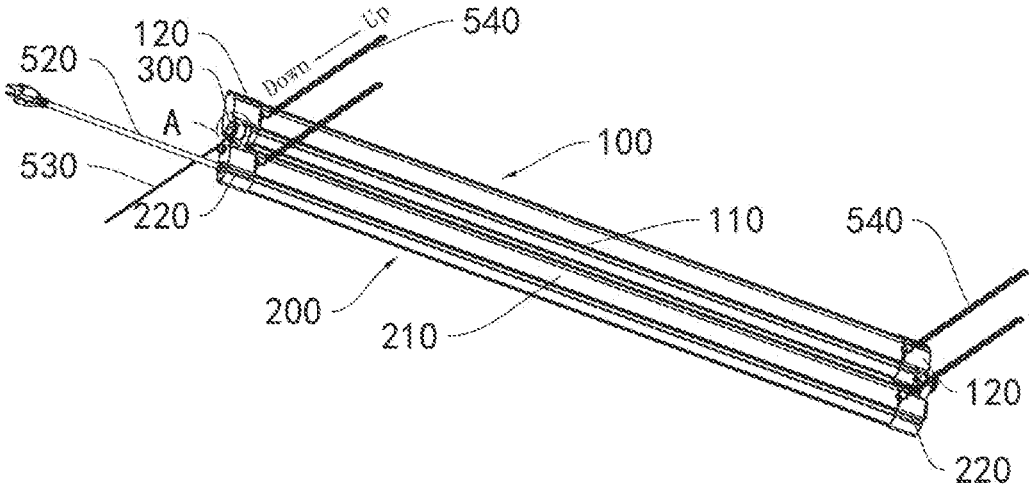
FIG. 1 is a schematic structural diagram of a ceiling lamp according to an embodiment of the disclosure.

100 refers to first lamp, 110 refers to first connecting plate, 120 refers to first end shell, 130 refers to first lamp body, 200 refers to second lamp, 210 refers to second connecting plate, 220 refers to second end shell, 230 refers to second lamp body, 300 refers to angle adjusting and locking device, 410 refers to first gear assembly, 420 refers to second gear assembly, 430 refers to spring, 440 refers to pressing member, 510 refers to connecting shaft, 520 refers to plug, 530 refers to pull switch, 540 refers to chain, and 550 refers to scale.

DETAILED DESCRIPTION

The embodiments of the disclosure will be described in detail hereinafter. Examples of the embodiments are shown in the drawings. The same or similar reference numerals throughout the drawings denote the same or similar elements or elements having the same or similar functions. The embodiments described below with reference to the drawings are exemplary and are only intended to explain the disclosure, but should not be construed as limiting the disclosure.

In the description of the disclosure, it should be understood that the orientations or positional relationships indicated by the terms such as "upper", "lower", "front", "rear", "left", "right" and the like, refer to the orientations or positional relationships shown in the drawings, which are only intended to facilitate describing the disclosure and simplifying the description, and do not indicate or imply that the indicated devices or elements must have a specific orientation, be constructed and operated in a specific orientation, and therefore cannot be understood as a limitation of the disclosure. If there are descriptions of "first" and "second", it is only for the purpose of distinguishing technical features, and should not be understood as indicating or implying relative importance, implicitly indicating the number of the indicated technical features or implicitly indicating the order of the indicated technical features.

In the description of the disclosure, the terms "arrangement", "installation", "connection", and the like should be understood in broad sense unless otherwise specified and defined. The specific meaning of the above terms in the disclosure may be reasonably determined according to specific contents of the technical solutions by those having ordinary skills in the art.

A ceiling lamp is provided according to an embodiment of the disclosure. With reference to the embodiments shown in FIG. 1 to FIG. 6, the ceiling lamp includes:

a first lamp 100;

a second lamp 200, wherein the first lamp 100 and the second lamp 200 are arranged at an interval; and the second lamp 200 and the first lamp 100 are rotatable with respect to each other; and an angle adjusting and locking device 300, wherein the angle adjusting and locking device 300 is connected with the first lamp 100 and the second lamp 200, and the angle adjusting and locking device 300 is configured for locking the first lamp 100 and the second lamp 200 after they are rotated with respect to each other.

Therefore, an included angle between the first lamp 100 and the second lamp 200 can be adjusted according to an illuminating range, and when the included angle between the first lamp 100 and the second lamp 200 is determined, the first lamp 100 and the second lamp 200 are locked by the angle adjusting and locking device, so that the included angle between the first lamp 100 and the second lamp 200 is maintained. Then, the ceiling lamp with the fixed included angle is suspended from a ceiling, thus meeting illuminating requirements of different illuminating ranges. Therefore, the lamp according to the embodiment of the disclosure has a stronger applicability.

It should be noted that the first lamp 100 may be an independent lamp, or a lamp formed by a plurality of lamps connected in series, so that adjustment may be carried out by taking adjacent sides of the first lamp 100 and the second lamp 200 as a dividing line. The lamp may be a long lamp shell as shown in FIG. 1, and a LED lamp strip is arranged in the lamp shell.

It should be noted that, the first lamp 100 and the second lamp 200 may be turned up to increase a wide angle, thus expanding an illuminating range, or the first lamp 100 and the second lamp 200 may also be turned down, thus reducing the illuminating range. In some embodiments, the first lamp 100 and the second lamp 200 may both be rotationally arranged. In other embodiments, only the first lamp 100 or the second lamp 200 is rotatable, and the included angle between the first lamp 100 and the second lamp 200 may be adjusted in a range of 0 degree to 180 degrees.

Figure 2:
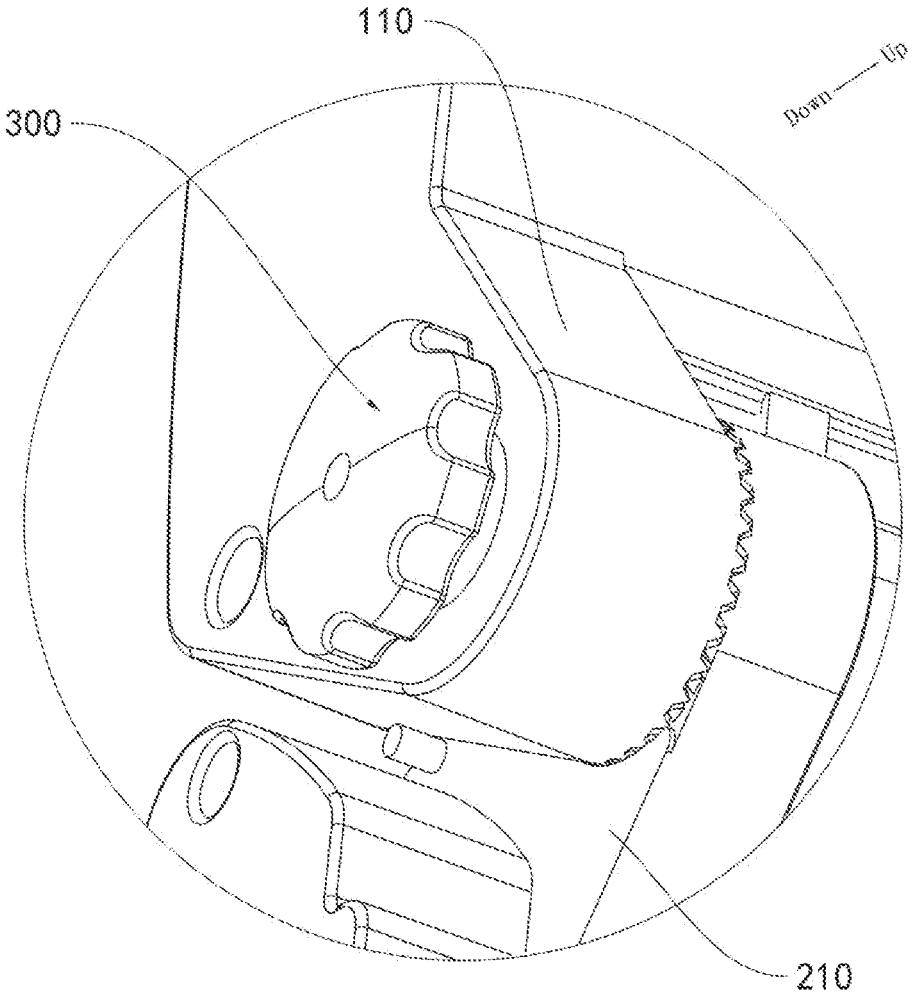
FIG. 2 is an enlarged view of a portion A according to the embodiment shown in FIG. 1.
Figure 3:
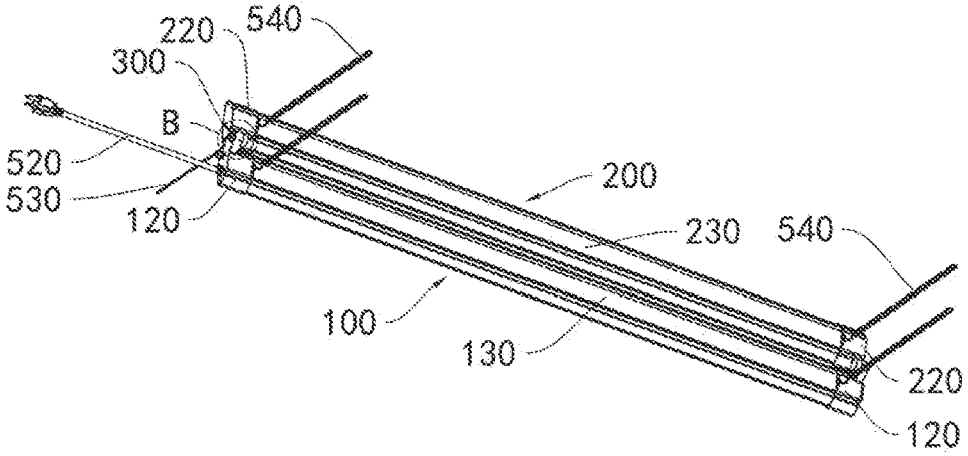
FIG. 3 is a schematic structural diagram of a ceiling lamp according to another embodiment of the disclosure.
Figure 4:
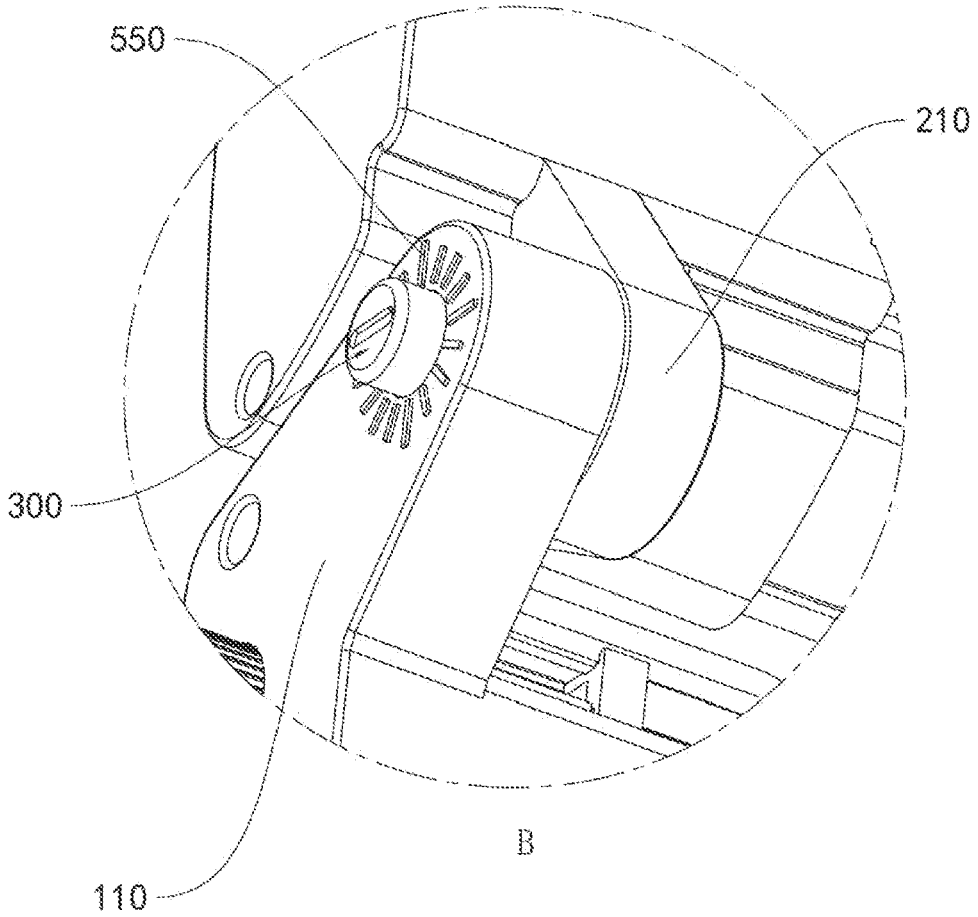
FIG. 4 is an enlarged view of a portion B according to the embodiment shown in FIG. 3.

It can be understood that, with reference to the embodiments shown in FIG. 2 to FIG. 4, two ends of the first lamp 100 are both provided with a first connecting plate 110 inclined upwardly; two ends of the second lamp 200 are both provided with a second connecting plate 210 inclined upwardly; and the first connecting plate 110 is rotationally connected with and abutted against the second connecting plate 210 located at the same end, and the angle adjusting and locking device 300 is configured for locking the first connecting plate 110 and the second connecting plate 210 after they are rotated with respect to each other.

It should be noted that, with reference to the embodiment shown in FIG. 2, downwardly inclined arrangement enables a small gap between the first lamp 100 and the second lamp 200. Meanwhile, after rotated inversely, the gap between the two lamps may be adjusted to provide better illumination.

It can be understood that, with reference to the embodiment shown in FIG. 2, two angle adjusting and locking devices 300 are provided, the two angle adjusting and locking devices 300 are respectively located at two ends of the first lamp 100, one of the angle adjusting and locking devices 300 is set as a bolt, the bolt penetrates through the first connecting plate 110 and the second connecting plate 210 at the corresponding end, and the bolt is configured for locking the corresponding first connecting plate 110 and second connecting plate 210.

It should be noted that, in some embodiments, the two angle adjusting and locking devices 300 may both be a bolt. In other embodiments, one angle adjusting and locking device 300 is a bolt, and the other angle adjusting and locking device 300 is a rotary buckle.

Figure 5:
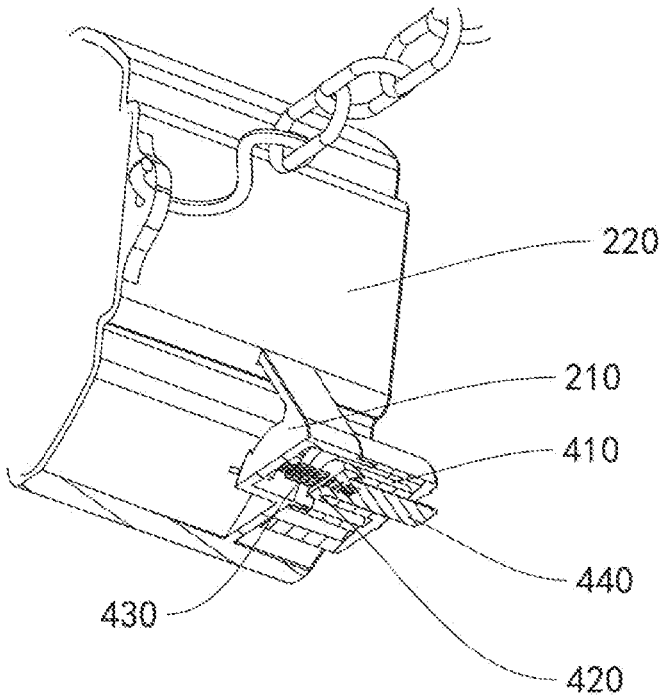
FIG. 5 is a schematic diagram of a partial cross section according to the embodiment shown in FIG. 3.
Figure 6:
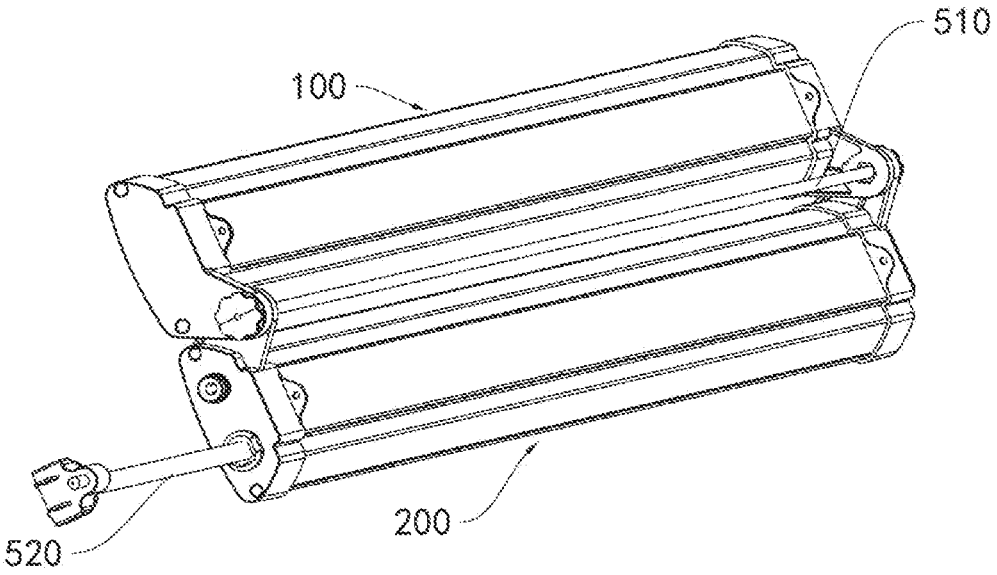
FIG. 6 is a schematic structural diagram of a ceiling lamp with a connecting shaft according to an embodiment of the disclosure.

It can be understood that, with reference to the embodiments shown in FIG. 3 and FIG. 5, two angle adjusting and locking devices 300 are provided, the two angle adjusting and locking devices 300 are respectively located at two ends of the first lamp 100, one of the angle adjusting and locking devices 300 includes a first gear assembly 410, a second gear assembly 420, a spring 430 and a pressing member 440, the first gear assembly 410 penetrates through the first connecting plate 110 at the corresponding end, and the second gear assembly 420 penetrates through the second connecting plate 210 at the corresponding end. One end of the first gear assembly 410 is engaged with one end of the second gear assembly 420, and one end of the spring 430 is abutted against one end of the second gear assembly 420. The other end of the spring 430 is connected with the second connecting plate 210 at the corresponding end. The spring 430 is configured for providing an elastic force for one end of the second gear assembly 420 towards the first gear assembly 410, and one end of the pressing member 440 penetrates through the first gear assembly 410 and is abutted against one end of the second gear assembly 420, so that the spring 430 is capable of being compressed when the pressing member 440 is pressed, and the first gear assembly 410 and the second gear assembly 420 are separated.

It should be noted that, with reference to FIG. 5, the pressing member 440 penetrates through the first gear assembly 410 and the second gear assembly 420 in sequence, and the spring 430 is partially embedded in one end of the pressing member 440 far away from the first gear assembly 410.

It should be noted that, in some embodiments, the gear assembly as shown in FIG. 3 may be provided at one end, and the both may be provided at the other end. In other embodiments, the gear assembly may be provided at both ends.

It should be noted that, with reference to the embodiment shown in FIG. 5, the first gear assembly 410 and the second gear assembly 420 are both a groove, with opposite notches, and the first gear assembly 410 and the second gear assembly 420 are integrally formed with the first connecting plate 110 and the second connecting plate 210 respectively. It should be noted that, with reference to the embodiment shown in FIG. 4, the first gear assembly 410 protrudes from a surface of the first connecting plate 110, and several scales 550 are arranged at a junction between the first connecting plate 110 and the first gear assembly 410 to remind a user of a rotating angle.

It can be understood that, two angle adjusting and locking devices 300 are provided, the two angle adjusting and locking devices 300 are respectively located at two ends of the first lamp 100, one of the angle adjusting and locking devices 300 includes a motor configured for adjusting an included angle between the first connecting plate 110 and the second connecting plate 210.

It should be noted that, in some embodiments, after the included angle between the first connecting plate 110 and the second connecting plate 210 is adjusted by the motor, the angle may be fixed. In other embodiments, after the included angle between the first connecting plate 110 and the second connecting plate 210 is adjusted by the motor, the first connecting plate and the second connecting plate are locked by the other locking device.

It can be understood that, with reference to the embodiments shown in FIG. 1 to FIG. 6, the first lamp 100 includes a first end shell 120 and a first lamp body 130, the first end shell 120 is detachably connected with the first lamp body 130, the second lamp 200 includes a second end shell 220 and a second lamp body 230, the second end shell 220 is detachably connected with the second lamp body 230, and the angle adjusting and locking device 300 is configured for locking the first end shell 120 and the second end shell 220 after they are rotated with respect to each other.

It should be noted that, in some embodiments, the first connecting plate 110 and the first end shell 120 are integrally formed, and the second connecting plate 210 and the second end shell 220 are integrally formed. In other embodiments, the first connecting plate 110 is detachably arranged on the first end shell 120, and the second connecting plate 210 is detachably arranged on the second end shell 220.

It should be noted that, the first lamp body 130 and the second lamp body 230 are both provided with a lamp strip.

It can be understood that, one end of the first lamp 100 is provided with a jack, and an outer surface of one end of the first lamp 100 and/or the second lamp 200 far away from the jack is provided with a plug 520.

It should be noted that, when a plurality of ceiling lamps need to be mounted, the plurality of ceiling lamps may use the ceiling lamp in the disclosure, and the plurality of ceiling lamps may be mounted by one plug 520 via connecting the jack and the plug 520 of two adjacent ceiling lamps.

It can be understood that, the first lamp 100 or the second lamp 200 is provided with a pull switch 530.

It should be noted that, a zipper-type switch is convenient for switching on and off a lamp, and may be configured for controlling a single lamp or double lamps as required, such as setting two pull switches 530 to control the first lamp 100 and the second lamp 200 respectively, or setting one pull switch 530 to control switching on and off of both the first lamp 100 and the second lamp 200.

It can be understood that, the ceiling lamp further includes: a connecting shaft 510. The connecting shaft 510 is arranged between the first lamp 100 and the second lamp 200, and two ends of the connecting shaft 510 are both connected with the first lamp 100 and the second lamp 200.

It should be noted that, stability of connection between the first lamp 100 and the second lamp 200 can be further improved by setting the connecting shaft 510. It should be noted that, when there is no connecting shaft 510 as shown in FIG. 1 to FIG. 4, stability of the lamp can be ensured by mounting chains 540 of the first lamp 100 and the second lamp 200.

It can be understood that, the ceiling lamp further includes at least one of: a sensing module and/or a voice control module.

It can be understood that, in some embodiments, the ceiling lamp is provided with the sensing module, and the ceiling lamp may be automatically switched on when someone passes by. In other embodiments, the ceiling lamp is provided with the voice control module, and switching on and off of the ceiling lamp may be controlled by voice. It should be noted that, in some embodiments, the sensing module and the voice control module are arranged at the same time. It should be noted that, in some embodiments, at least one of the sensing module and the voice control module is matched with the pull switch 530, so that two ways of manually switching on the lamp and intelligently switching on the lamp can be realized.

It should be noted that, with reference to the embodiments shown in FIG. 1 to FIG. 6, the chain 540 is connected with the lamp by a lifting hook, which is more convenient for mounting and maintenance.

In the descriptions of the specification, the descriptions with reference to the terms "one embodiment", "some embodiments", "illustrative embodiment", "example", "specific example" or "some examples", etc., refer to that specific features, structures, materials, or characteristics described with reference to the embodiments or examples are included in at least one embodiment or example of the disclosure. In the specification, the schematic representation of the above terms does not necessarily mean the same embodiment or example. Moreover, the specific features, structures, materials or characteristics described may be combined in any one or more embodiments or examples in a suitable manner.

Although the embodiments of the disclosure have been shown and described, those of ordinary skills in the art should understand that: various changes, amendments, substitutions and modifications can be made to these embodiments without departing from the principles and purposes of the disclosure, and the scope of the disclosure is limited by the claims and equivalents thereof.

The embodiments of the disclosure are described in detail with reference to the drawings above, but the disclosure is not limited to the above embodiments, and various changes may also be made within the knowledge scope of those of ordinary skills in the art without departing from the purpose of the disclosure.

What is claimed is:

1. A ceiling lamp, comprising:

a first lamp;

a second lamp, wherein the first lamp and the second lamp are arranged at an interval; and the second lamp and the first lamp are rotatable with respect to each other; and an angle adjusting and locking device, wherein the angle adjusting and locking device is connected with the first lamp and the second lamp, and the angle adjusting and locking device is configured for locking the first lamp and the second lamp after the first lamp and the second lamp are rotated with respect to each other;

wherein the first lamp comprises two ends, and wherein both ends of the first lamp are provided with a first connecting plate inclined upwardly;

wherein the second lamp comprises two ends, and wherein both ends of the second lamp are provided with a second connecting plate inclined upwardly; and wherein the first connecting plate is rotationally connected with and abutted against the second connecting plate located at the same end, and the angle adjusting and locking device is configured for locking the first connecting plate and the second connecting plate after the first connecting plate and the second connecting plate are rotated with respect to each other.

2. The ceiling lamp according to claim 1, wherein, the angle adjusting and locking device is provided in two, the two angle adjusting and locking devices are located at opposite ends of the first lamp, one of the angle adjusting and locking devices is set as a bolt penetrating through the first connecting plate and the second connecting plate at a corresponding end, and the bolt is configured for locking the corresponding first connecting plate and second connecting plate.

3. The ceiling lamp according to claim 1, wherein, the angle adjusting and locking device is provided in two, the two angle adjusting and locking devices are located at opposite ends of the first lamp, one of the angle adjusting and locking devices comprises a first gear assembly, a second gear assembly, a spring and a pressing member, the first gear assembly is configured to penetrate through the first connecting plate at the corresponding end of the first lamp, and the second gear assembly is configured to penetrate through the second connecting plate at the corresponding end of the first lamp; one end of the first gear assembly is engaged with one end of the second gear assembly, and one end of the spring is abutted against one end of the second gear assembly; another end of the spring is connected with the second connecting plate at the corresponding end; and the spring is configured for providing an elastic force for one end of the second gear assembly towards the first gear assembly, and one end of the pressing member is configured to penetrate through the first gear assembly to be abutted against one end of the second gear assembly, so that the spring is capable of being compressed when the pressing member is pressed, to separate the first gear assembly from the second gear assembly.

4. The ceiling lamp according to claim 1, wherein, the first lamp comprises a first end shell and a first lamp body, the first end shell is detachably connected with the first lamp body, the second lamp comprises a second end shell and a second lamp body, the second end shell is detachably connected with the second lamp body, and the angle adjusting and locking device is configured for locking the first end shell and the second end shell after the first end shell and the second end shell are rotated with respect to each other.

5. The ceiling lamp according to claim 1, wherein, the first lamp or the second lamp is provided with a pull switch.

6. The ceiling lamp according to claim 1, further comprising:

a connecting shaft, wherein the connecting shaft is arranged between the first lamp and the second lamp, and the connecting shaft comprises two ends, which are both connected with the first lamp and the second lamp.

* * * * *